US005201473A

United States Patent [19]

Pollock

[11] Patent Number: 5,201,473

[45] Date of Patent: Apr. 13, 1993

[54] DRY MATERIAL FEEDER AND MEASURING DEVICE

[75] Inventor: John E. Pollock, Wellsville, Kans.

[73] Assignee: Central Fiber Corporation, Wellsville, Kans.

[21] Appl. No.: 673,750

[22] Filed: Mar. 22, 1991

[51] Int. Cl.[5] ..... B02C 17/16

[52] U.S. Cl. ..... 241/36; 241/57

[58] Field of Search ..... 241/57, 36, 260.1; 366/104, 603, 299, 141

[56] References Cited

U.S. PATENT DOCUMENTS

| | | | |
|---|---|---|---|
| 3,125,294 | 3/1964 | Lill | 366/299 |
| 3,458,141 | 7/1969 | Lenz | 241/36 |
| 4,135,827 | 1/1979 | Thomas | 366/141 |
| 4,462,693 | 7/1984 | Buschbom et al. | 366/189 |
| 4,664,527 | 5/1987 | Schuler | 366/141 |
| 4,673,134 | 6/1987 | Barthelmess | 241/57 |
| 4,801,433 | 1/1989 | Yamanaka et al. | 422/228 |

*Primary Examiner*—Timothy V. Eley
*Assistant Examiner*—John M. Husar

[57] ABSTRACT

A material feeding and measuring device includes a housing defining an interior cavity or bin and having a plurality of agitators and an auger rotatably mounted therein. The agitators are arranged as a first upper row and take the form of a plurality of rotatably mounted rods extending across the bin. Each of the rods includes a plurality of tines extending radially outwardly. A lower level of agitators, having the same form, are provided adjacent the bottom of the bin. An auger is rotatably mounted near the bottom center of the bin. The auger extends a slight distance out of the bin into an exit flange which surrounds the periphery of the auger. A blower and conduit are arranged to cause an airstream to flow across the end of the exit flange to entrain the material in the airstream for conveyance. The entire housing is mounted upon load cells which are operatively connected to an electronic control device. In operation, compressed or partially compressed material is placed within the bin and the initial weight determined. The desired quantity and/or rate of material to be processed is then input to the control device, which automatically starts operation of the device. The control device monitors the load cells to adjust the operating speed of the motor driving the auger and/or agitators to control the output from the device. Upon dispensing the desired amount of material, the control device ends motor operation, and thus dispensing.

21 Claims, 3 Drawing Sheets

DRY MATERIAL FEEDER AND MEASURING DEVICE

BACKGROUND OF THE INVENTION

1. Field of the Invention

The present invention relates in general to comminution and dispensing devices. In particular, the present invention relates to an improved device for comminuting or "fluffing" compacted particulate material and for dispensing a predetermined quantity of this material.

2. Description of the Related Art

In recent years the use of, and uses for, ground paper products has increased dramatically. Ground paper products include used newspapers, magazines, cardboard and other paper products which are shredded and ground to consistencies ranging from small fibrous particulates to extremely fine powders. Such ground paper products may be mixed with grass seed, fertilizer and a binder to form a spray on coating which may be used to promote the growth of grass adjacent highway construction sites. Alternatively, the ground paper products may be treated with appropriate flame retardant materials for use as insulation. Further uses are known, with new uses sure to be discovered.

It has previously been known to package the ground paper products in bags for shipment to the particular facility which will combine the paper products with the other materials to form the end product. During this packaging the ground paper products become compacted.

The present inventors believe that subjecting the ground paper products to comminution or "fluffing" prior to use, to ensure that the paper products are in the proper particulate form to be combined with the other materials, would be beneficial.

SUMMARY OF THE INVENTION

An object of the present invention is to provide a device for the improved comminution or "fluffing" of compressed or partially compressed material.

Another object of the present invention is to provide a device for the comminution or "fluffing" of which will dispense a predetermined quantity of such material.

A further object of the present invention is to provide a device for comminution or "fluffing" of material which will dispense such material at a predetermined rate.

These and other objects are achieved by an improved device comprising a housing defining an interior cavity or bin and having a plurality of agitators and an auger rotatably mounted therein. The agitators are arranged as a first upper row and take the form of a plurality of rotatably mounted rods extending across the bin substantially parallel to each other. Each of the rods includes a plurality of tines extending radially outwardly therefrom. A lower level of agitators, having the same form, are provided adjacent the bottom of the bin. An auger is rotatably mounted near the bottom center of the bin between pairs of the lower agitators. The auger extends a slight distance out of the bin into an exit flange which surrounds the periphery of the auger. A blower and conduit are arranged to cause an airstream to flow across the end of the exit flange, to entrain the particulate material in the airstream for conveyance. The entire housing is mounted upon a plurality of load cells which are operatively connected to an electronic control device. In operation, compressed or partially compressed material is placed within the bin and the initial weight determined. The desired quantity and/or rate of material to be processed is then input to the electronic control device, which automatically starts operation of the comminution device. The electronic control device monitors the load cells to adjust the operating speed of the motor driving the auger and/or agitators to control the output from the comminution device. Upon dispensing the desired amount of material, the electronic control device ends motor operation, and thus dispensing.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
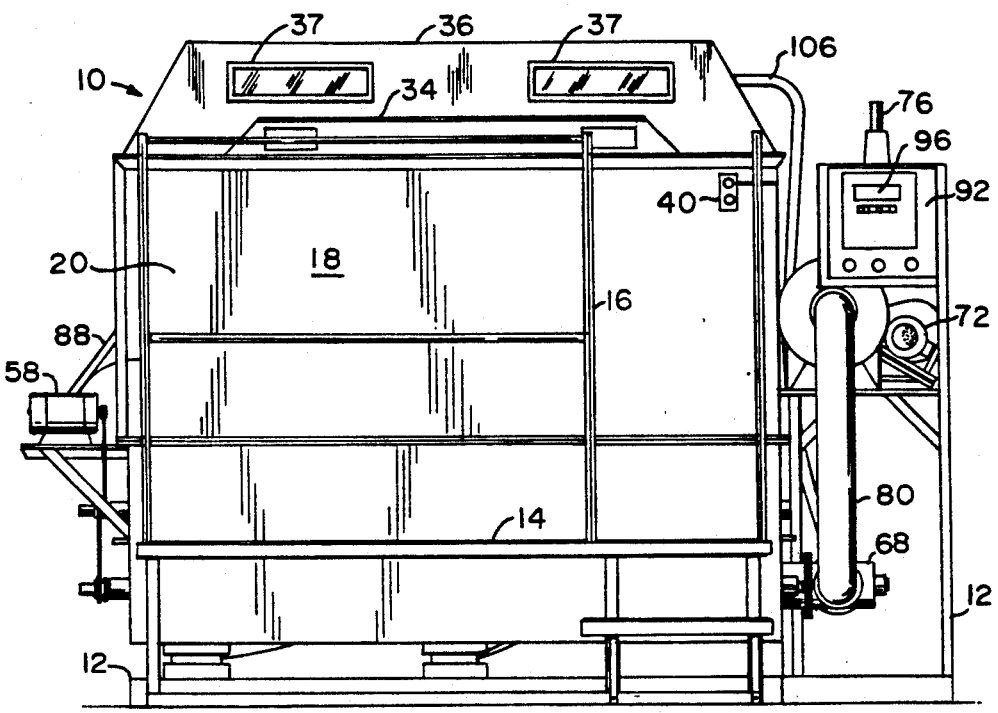
FIG. 1 is a front view of a first embodiment of the present invention.

With reference to the drawings, the device according to the present invention is generally designated by reference numeral 10. The device 10 includes a subframe 12 which rests upon the ground and supports the various components of device 10. Connected to subframe 12 is a platform 14 with appropriate railings 16 for operator access to the device 10.

Supported upon the subframe 12 is a main housing 18. Main housing 18 is essentially rectangular in shape and includes front and rear walls 20 and 22, right and left walls 24 and 26 and a bottom 28. The walls of the main housing 18 define an interior cavity or bin 30 within main housing 18.

Bin 30 includes an upper opening 32 which allows access to the bin. Main housing 18 may include lifting lugs 34 adjacent upper opening 32 to allow the main housing to be engaged with a forklift or other lifting device for placement of the main housing in the proper position.

Upper opening 32 may be selectively closed by use of a hood 36. The hood 36 may advantageously be hinged to the upper edge of rear wall 22 and include a pair of windows 37 to allow the operator to observe the process. Hood 36 may include a lifting handle to allow the hood to be opened and closed about the hinges for access to bin 30. However, it is preferred that the hood 36 include a piston and cylinder arrangement hinged to rear wall 22 and hood 36 for powered raising and lowering of the hood. Piston and cylinder 38 may be controlled by a standard actuator 40 which preferably includes an interlock to automatically cease operation of the device upon opening of the hood 36.

Figure 3:
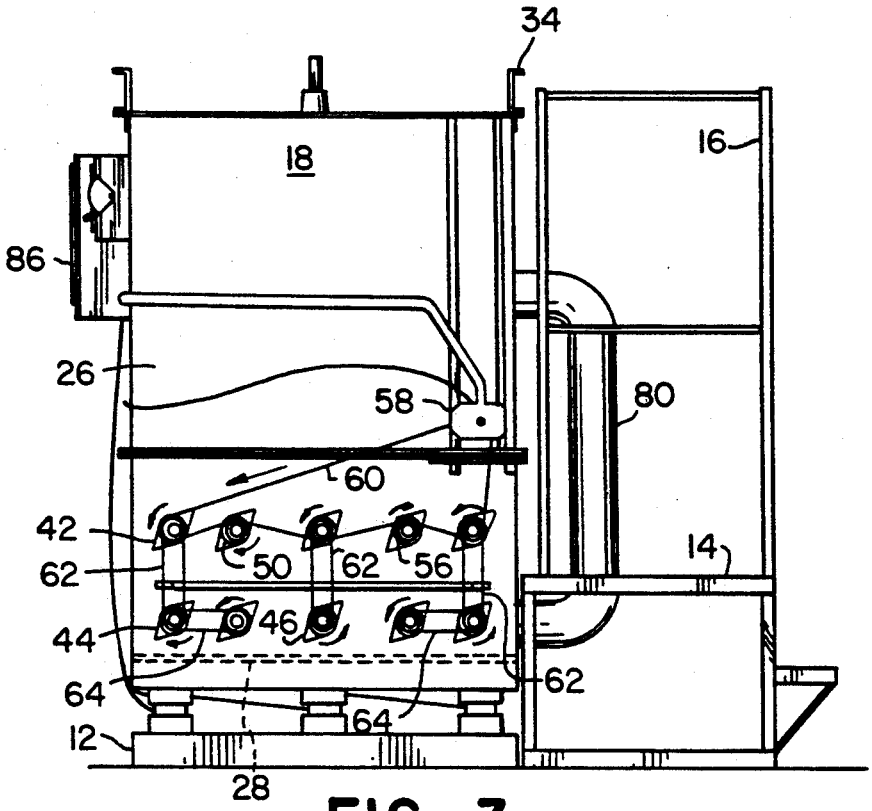
FIG. 3 is a left side view of a second embodiment of the present invention.
Figure 4:
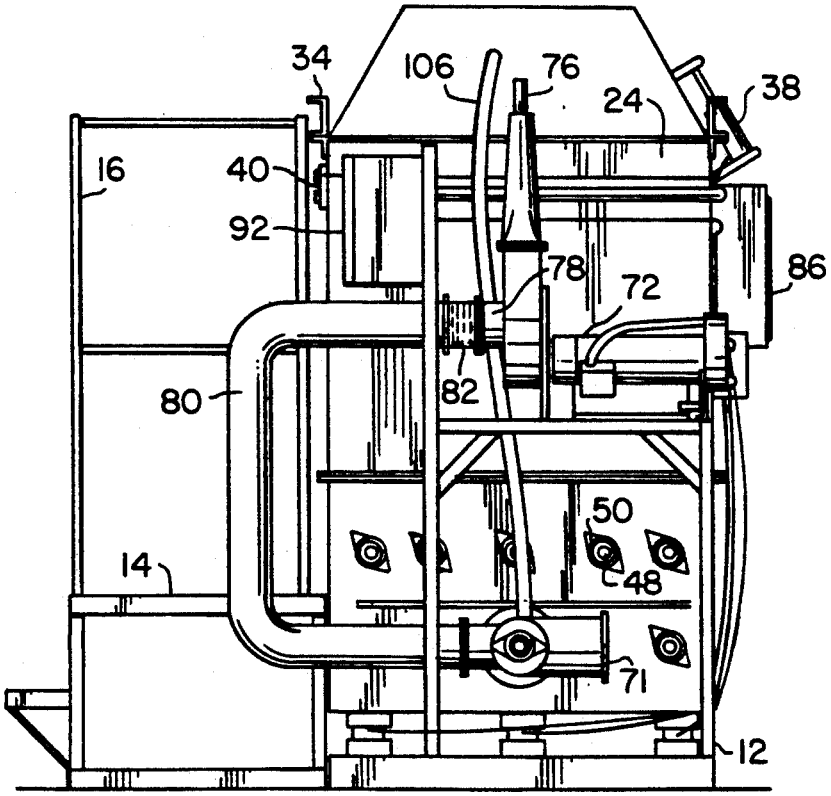
FIG. 4 is a right side view of a first embodiment of the present invention.
Figure 6:
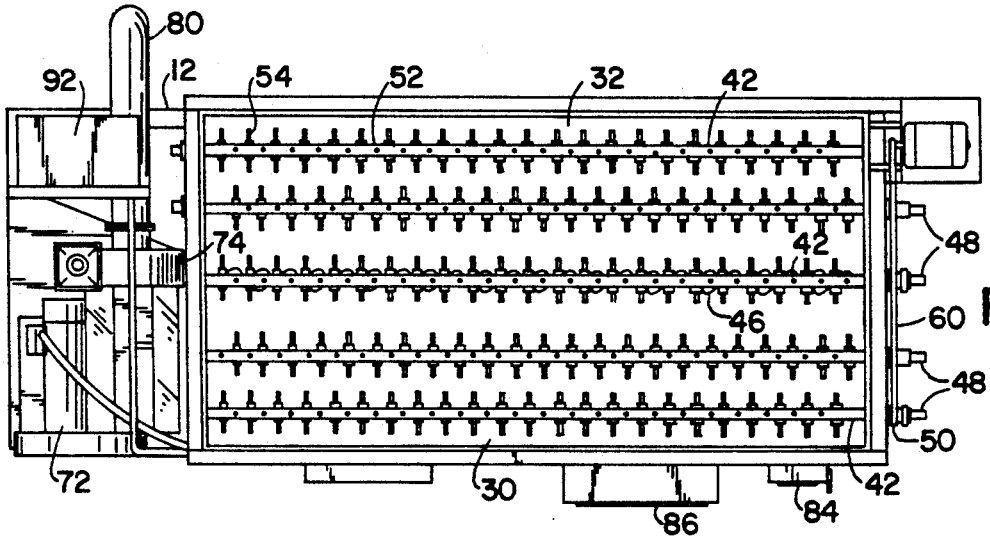
FIG. 6 is a top view of the device, showing the interior arrangement of the agitators and auger.

Located within the bin 30 is means for comminuting or "fluffing" the compacted or partially compacted product. As best shown in FIGS. 3 and 6, this means includes an upper level of agitators 42, lower level agitators 44 and an auger 46. Each of the elements 32 through 46 takes the general form of a rod extending between the right and left walls 24 and 26 of main housing 18. More specifically, each of the right and left walls 24 and 26 will include an array of short rod segments 48 having interior ends extending a short distance into the interior of bin 30, and being mounted in appropriate bearings 50. The agitators 42 and 44 and auger 46 may then be advantageously formed of a length of rigid pipe 52 fixably connected to the interior ends of the rod segments 48. The rigid pipes 52 may alternatively be releasably connected to rod segments 48 to allow easy disassembly of the device 10.

Each of the agitators 42 and 44 includes a plurality of radially outwardly extending tines 54. The tines may be advantageously formed from a length of all-thread extending through a radial hole in pipe 52. Appropriate nuts screwed upon the all-thread and engaging the exterior of the pipe 52 will then hold the tines 54 in a rigid, yet removable, position. The auger 46 includes an appropriate helical land fixed to the exterior of the pipe 52, as by weldinq. As will be described in more detail later, this helical land does not extend the full length of the pipe 52 forming the auger 56. The agitators and auger extend substantially parallel to each other.

The rod segments 48 extending outwardly from left wall 26 include sprockets 56 to allow the rod segments, and thus the agitators and auger to be driven by a chain drive. As is best shown in FIG. 3, a drive motor 58 is mounted upon main housing 18 and includes an appropriate sprocket and/or gear reducer for engagement with main drive chain 60. Main drive chain 60 extends about, and in operative engagement with, each of the sprockets 56 of the rod segments of the upper level agitators 42. Drive chain 60 is engaged with the sprockets 56 of agitators 42 such that the upper level agitators will each rotate in a direction opposite to an adjacent upper level agitator.

The lower level agitators 44 located adjacent the front and rear walls 20 and 22 and the agitator (located near the center of the side walls between the lower level agitators) are driven from the rotation of the rod segments 48 by secondary chains 62 engaged with appropriate sprockets 56 on the respective rod segments 48. Finally, the remaining lower level agitators 44 located adjacent the auger 46 are driven by rotation of the exterior lower level agitators by means of tertiary chains 64 engaged with appropriate sprockets 56 on the respective rod segments 48.

With this drive chain arrangement the various agitators and the auger will rotate in the direction indicated by the arrows in FIG. 3. While other drive chain arrangements, and thus rotations, are feasible, the present arrangement with the upper level agitators each rotating in a direction opposite that of an adjacent upper level agitator and the lower level agitators adjacent the auger rotating in the same direction has proved to be advantageous.

It should be stated that the particular number and arrangement of agitators and augers may be varied to suit particular needs. For example, fewer or more agitators and/or augers may be employed. Additionally or alternatively, the agitators and auger may be arranged in a configuration other than upper and lower rows.

Figure 2:
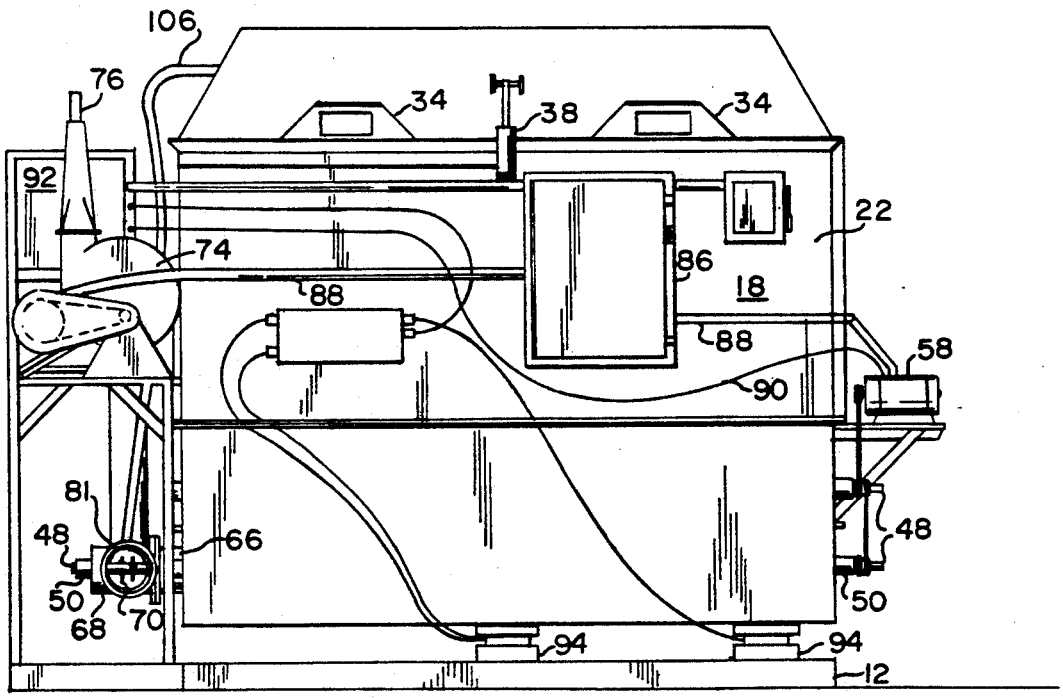
FIG. 2 is a rear view of a first embodiment of the present invention.

As noted above, the helical lands forming the auger do not extend the full length of its associated pipe 52. As is best shown in FIG. 2, the pipe 52 of auger 46 extends outwardly of the bin 30 through an exit flange 66 communicating with the bin 30. Exit flange 66 communicates with a dispenser fitting 68 releasably connected to exit flange 66. The pipe 52 of auger 46 extends into the dispenser fitting 68 and is connected to the rod segment 48 which is rotatably mounted in a bearing 50 in the exterior end of dispenser fitting 68. As such, the right hand end of auger 56 is not rotatably mounted in the right wall 24 of main housing 18, but is instead rotatably mounted in the dispenser fitting 68. The helical land forming the auger 46 ceases proximate the end of exit flange 66, with the diameter of exit flange 66 substantially conforming to the exterior diameter of the helical land of the auger. As a final safeguard against any compacting of the material during conveyance by the auger 46, the right hand end of pipe 52 of auger 56 includes a pair of dispenser tines 70 which may be of the same form as tines 54 previously described.

As may be readily apparent from the structure described above, when a mass of compressed or partially compressed material is placed within bin 30 and the drive motor 58 actuated, the movement of drive motor 58 is transmitted through the various chains 60 through 64 to cause rotation of the agitators 42 and 44 and auger 46. This rotary movement will cause the various tines on the agitators to engage the mass of material and comminute (or, since the mass has by definition been previously comminuted, "fluff") the material to a fine particulate form as was present previous to compaction. The particulate material will fall by gravity to the bottom 28 of the bin 30 where it will be engaged by the helical lands of auger 46 and conveyed from left to right in the bin until it passes through exit flange 66 into dispenser fitting 68. At this point the particulate material is given a final "fluffing" to ensure entrainment of the particulate material in a fluid stream passing through dispenser fitting 68.

The fluid stream is provided by a blower means operatively connected to dispenser fitting 68. Specifically, mounted upon subframe 12 is an appropriate blower motor 72. Blower motor 72 is operatively connected, as by a chain or belt drive, to a blower 74. The dispenser fitting 68 includes an air inlet 71 adjacent the dispenser tines 70 which may be connected to an appropriate conduit to ensure an adequate supply of uncontaminated air. The blower 74 also includes an air inlet fitting 78 operatively connected to a blower conduit 80 which is in turn operatively connected to the dispenser fitting 68. The dispenser fitting 68 includes a duct 81 passing through the dispenser fitting at approximately a right angle to the axis of pipe 52 of auger 46 through which the fluid stream will flow. The blower 74 also includes an outlet fitting 76 through which the fluid stream, with the particulate material entrained therein, will pass. The outlet fitting 76 may be connected to an appropriate conduit to guide the entrained material to the desired location.

The blower conduit 80 may be formed of a flexible material, but is preferably formed of a rigid material for durability. Where the blower conduit 80 is formed of a rigid material, a flexible conduit segment 82 is mounted between the air outlet fittings 78 and blower conduit 80 for a purpose described below.

Electrical power is supplied to the drive motor 58 and blower motor 72 by a main power box 84, secondary power box 86 and appropriate electrical conduits 88. The drive motor 58 is preferably controllable as to its rpm, and is operatively connected as by a control line 90 to an electronic controller 92. The electronic controller 92 is connected to the secondary power box 86 such that it may control the power to the drive motor 58 and blower motor 72, and thus control operation of the device 10.

Figure 7:
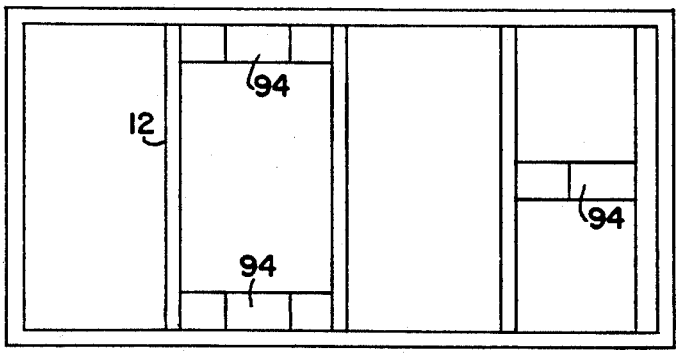
FIG. 7 is a bottom view of the device showing the load cell arrangement.

Controller 92 functions to control the device such that it dispenses an accurate amount of the material. To this end, the main housing 18 is mounted upon subframe 12 with a plurality of load cells 94 interposed therebetween. This arrangement of load cells is best shown in FIG. 7. The load cells are operatively connected to a "J" box to condition the signals from the load cells 94. The "J" box is, in turn, connected to the controller 92 such that the controller has access to the conditioned signals from the load cells 94. As such, the controller 92 may sense the total weight of main housing 18 and the mass of material contained therein and display it on a display segment 96 of controller 92.

While load cells have been described and shown, it should be apparent that other weight sensing means, including scales, may alternatively be employed.

The operator may then input a desired quantity (in weight) of material desired to be dispensed. The controller will then begin operation of drive motor 58 and blower motor 72 while continuously sensing the information from load cells 94. Upon the weight of the main housing 18 and material contained therein being reduced by the amount input by the operator, the controller 92 will automatically cease operation of the drive motor 58 and blower motor 72.

The drive motor 58, chain and sprocket arrangements are typically formed such that the agitators will rotate at between 0–750 rpm, with 0–80 rpm being typical, and the auger will rotate at between 0 to 1000 rpm, with 0–125 rpm being typical. It should be noted that the auger 46 may be provided with a separate drive motor controlled by the electronic controller 92, with the agitators 42 and 44 driven at a constant speed or at a speed setting equal to or different from that of the auger 46, yet controlled by electronic controller 92. The blower will operate at approximately 8,000 to 9,000 rpm.

The electronic controller is an important feature of the present invention. By this means an accurate amount of the material is dispensed to ensure quality control of the product in which the material is used. Additionally, due to the comminution or "fluffing" characteristics of the present device the material may be heavily compressed for shipment, thus saving space and allowing larger amounts of the material to be transported on a single load. This reduction in freight expense can be dramatic.

The controller 92, when supplied with a timer, may also be used to control the rate at which the material is dispensed. As in the previous example the controller will initially sense the weight of the main housing 18 and mass of material contained therein. This will be displayed on the display segment 96, at which point the operator will input the desired dispensing rate, for example in pounds per minute. The controller 92 will then supply power to the drive motor 58 and blower motor 72 to begin operation of the device. The controller 92 will then continuously sense the weight of the main housing 18 and mass of material contained therein at regular intervals of time. The controller may then vary the rpm of drive motor 58 to ensure that the proper rate of dispensing is achieved.

It is noted that the blower conduit 80 extends from the blower, which is mounted on the subframe to the dispenser fitting 68 mounted on the main housing 18. To ensure proper operation of the load cells by allowing free movement of the main housing 18 with respect to subframe 12, the blower conduit 80 should be formed from a flexible material, or the flexible conduit segment 82 should be included.

Figure 5:
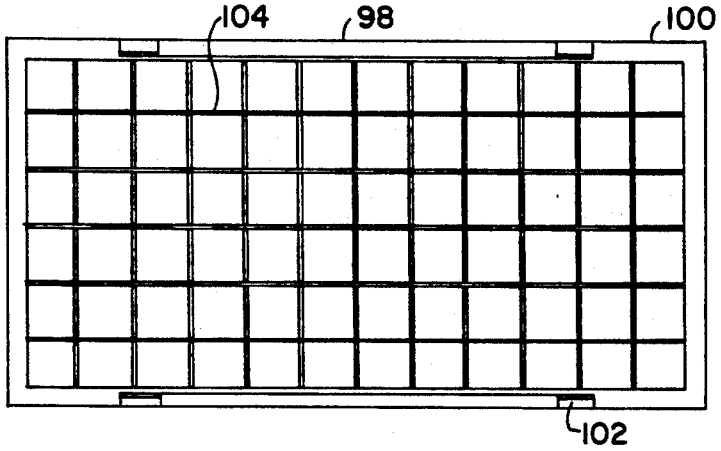
FIG. 5 is a top view of a lid which may be employed with the second embodiment of the invention.

A modification or second embodiment of the invention is shown in FIGS. 3, 5 and 6. In this embodiment, the hood 36 has been removed and replaced by a grating lid 98, shown in FIG. 5. The grating lid 98 includes a peripheral frame 100 with appropriate lifting handles 102. The frame 100 is sized to fit upon the side and front walls of the main housing 18. Within the periphery of frame 100 is a grating 104 comprised of a wire mesh or a lattice of metallic rods. The grating 104 will serve to limit access of an operator to the interior of the main housing 18 to prevent operator injury. While this is a suitable arrangement, the use of hood 36 is preferred, in that it provides improved safety over the grating lid 98, reduces noise and reduces the amount of dust from the material entering the work place atmosphere.

Along these lines, the hood 36 may be modified to reduce the amount of dust entering the work place atmosphere. Specifically, an air conduit 106 may be operatively connected to the hood 36 for communication with the bin 30. The air conduit 36 will then extend downwardly from the hood to the dispenser fitting 68, with which it is in communication. During operation, the fluid flow past the end of air conduit 106 at the dispenser fitting 68 will cause reduced pressure within the air conduit 106. This will have the effect of creating a slight air flow within the bin 30 to the air conduit 106, thus removing airborne particles of the material.

From the above it may be seen that the device according to the present invention provides improved dispensing of material. The dispensing described above, however, has been of the batch variety in that a desired quantity of material will be dispensed, and then operations stopped. It should be noted however that a plurality of devices 10 may be provided, with the devices being controlled by a central controller such that the cessation of operation of one device 10 will cause the beginning of operation of another device 10. In this manner a continuous dispensing of material may be achieved. Alternatively, a conveyor for supplying masses of material to the bin 30 could be provided. Such a conveyor would have a load cell operatively connected to the controller 92 such that the amount of material added to the bin 30 would become an additional factor employed in the calculations of the electronic controller 92.

The device may also be modified to provide further comminution or "fluffing". Specifically, a fan mill in the form of a fan surrounded by a screen of appropriate mesh may be located downstream of the dispenser fitting. This would ensure that only particles or clumps of particles having a desired size are conveyed in the airstream. Alternatively, a fan with a hammer mill could be located downstream of the dispenser fitting.

While the device according to the present invention has been described in detail with regard to specific embodiments, it must be noted that various modifications may be made to the device. For example, the blower motor 72 could be operated for a few seconds longer than drive motor 58 to ensure that the particulate material is fully dispensed from dispenser fitting 68.

This may not be necessary, however, since the reduced friction associated with the blower motor and blower may result in this effect without the use of a timer. Additionally, the drive motor 58 and blower motor 72 need not be electric motors, but may be of other types with appropriate controls. As noted above, the number and arrangement of the agitators 42 and auger 46 may be varied, as may be their directions of rotation. Finally, the bottom 28 of the main housing 18 may have a sloped configuration rather than the flat configuration shown in the drawings.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A device for loosening a mass of particulate material and conveying a measured quantity of said material after loosening, comprising:

a housing defining an accessible bin therein, and said housing including an exit flange allowing further access to said bin;

a plurality of agitators rotatably mounted to said housing within said bin for causing said loosening of said mass of particulate material;

at least one auger rotatably mounted to said housing and extending at least into proximity of said exit flange whereby rotation of said auger will cause the material to be conveyed into said exit flange;

means for causing rotation of said agitators and auger; and fluid stream conveyance means operatively connected to said exit flange whereby the material conveyed by said auger to said exit flange is entrained in a fluid stream for conveyance from said exit flange.

2. A device as in claim 1, wherein each of said agitators includes a plurality of tines extending radially outwardly of its axis of rotation.

3. A device as in claim 2, wherein the axes of rotation of said agitators are substantially parallel.

4. A device as in claim 3, wherein said auger includes a helical land along at least a portion of its length.

5. A device as in claim 4, wherein said auger extends through said exit flange and said portion of said auger is located within said bin and said exit flange.

6. A device as in claim 5, wherein said conveyance means includes a dispenser fitting mounted on said exit flange, and wherein said auger has one end thereof rotatably mounted to said dispenser fitting.

7. A device as in claim 6, wherein said auger includes at least one tine extending radially outwardly from the axis of rotation of said auger, said at least one tine being located within said dispenser fitting.

8. A device as in claim 1, wherein said fluid stream conveyance means includes:

a dispenser fitting mounted on said exit flange and adapted to receive the material conveyed into said exit flange by said auger;

blower means; and a blower conduit operatively connected between said blower means and said dispenser fitting, whereby operation of said blower means will cause a fluid stream to pass through said blower conduit and said dispenser fitting to entrain the material received in said dispenser fitting.

9. A device as in claim 1, further comprising:

a subframe;

weight sensing means operatively mounted on said subframe, and said housing being mounted on said at least one load cell, whereby said sensing means produces signals relating to the weight of said housing and the material within said bin; and control means operatively connected to receive said signals from said sensing means, and operatively connected to control said means for causing rotation and said fluid stream conveyance means.

10. A device as in claim 9, wherein said control means controls the cessation of operation of said means for causing rotation and said fluid stream conveying means based upon said signals from said sensing means, whereby a predetermined weight of the material may be dispensed.

11. A device as in claim 10, wherein said control means additionally controls the speed of operation of said means for causing rotation.

12. A device as in claim 10, wherein said sensing means comprises at least one load cell.

13. A device as in claim 10, wherein each of said agitators includes a plurality of tines extending radially outwardly of its axis of rotation.

14. A device as in claim 13, wherein the axes of rotation of said agitators are substantially parallel.

15. A device as in claim 14, wherein said auger includes a helical land along at least a portion of its length.

16. A device as in claim 15, wherein said auger extends through said exit flange and said portion of said auger is located within said bin and said exit flange.

17. A device as in claim 16, wherein said conveyance means includes a dispenser fitting mounted on said exit flange, and wherein said auger has one end thereof rotatably mounted to said dispenser fitting.

18. A device as in claim 17, wherein said auger includes at least one tine extending radially outwardly from the axis of rotation of said auger, said at least one tine being located within said dispenser fitting.

19. A device as in claim 18, wherein said fluid stream conveyance means includes:

a dispenser fitting mounted on said exit flange and adapted to receive the material conveyed into said exit flange by said auger;

blower means; and a blower conduit operatively connected between said blower means and said dispenser fitting, whereby operation of said blower means will cause a fluid stream to pass through said blower conduit and said dispenser fitting to entrain the material received in said dispenser fitting.

20. A device as in claim 19, wherein said blower means is mounted on said subframe, and wherein at least a portion of said blower conduit means is flexible, whereby the connection of said blower conduit between said blower means and said dispenser fitting will not interfere with operation of said sensing means.

21. A material feeding and measuring device for loosening a mass of particulate material and conveying a measured quantity of said material after loosening, comprising:

a housing defining an accessible bin therein;

an exit flange in said housing allowing further access to said bin;

a plurality of agitators rotatably mounted to said housing within said bin for causing said loosening of said mass of particulate material;

at least one auger rotatably mounted to said housing in a plane below a plane in which at least one of said agitators is positioned, said auger extending at least into proximity of said exit flange, whereby rotation of said auger will cause the material to be conveyed into said exit flange;

means for causing rotation of said agitators and auger; and fluid stream conveyance means operatively connected to said exit flange, whereby the material conveyed by said auger to said exit flange is entrained in a fluid stream for conveyance from said exit flange.

* * * * *